United States Patent [19]

Gesing et al.

[11] Patent Number: 4,737,253

[45] Date of Patent: Apr. 12, 1988

[54] ALUMINIUM REDUCTION CELL

[75] Inventors: Adam J. Gesing; David N. Mitchell; Peter A. Wales; Douglas N. Reesor; Ernest W. Dewing, all of Kingston, Canada; Douglas J. Wheeler, Cleveland Heights, Ohio; Donald L. De Respiris, Mentor, Ohio; Joseph K. Walker, Beechwood, Ohio

[73] Assignee: Alcan International Limited, Montreal, Canada

[21] Appl. No.: 896,465

[22] Filed: Aug. 13, 1986

[30] Foreign Application Priority Data

Aug. 15, 1985 [GB] United Kingdom ..... 8520453

[51] Int. Cl.[4] ..... C25C 3/08; C25C 3/16

[52] U.S. Cl. ..... 204/243 R; 204/288; 204/290 R; 204/291; 204/292

[58] Field of Search ..... 204/243 R-247, 204/288, 289, 294, 67, 290 R, 291-292

[56] References Cited

U.S. PATENT DOCUMENTS

| | | | |
|---|---|---|---|
| 3,156,639 | 11/1964 | Kibby | 204/243 R X |
| 3,274,093 | 9/1966 | McMinn | 204/243 R |
| 3,287,247 | 11/1966 | Dewey | 204/243 R |
| 3,321,392 | 5/1967 | McMinn et al. | 204/243 R |
| 3,607,685 | 9/1971 | Johnson | 204/67 |
| 4,308,115 | 12/1981 | Foster, Jr. et al. | 204/294 X |
| 4,396,481 | 8/1983 | Pawlek et al. | 204/243 R |

*Primary Examiner*—Donald R. Valentine

*Attorney, Agent, or Firm*—Cooper, Dunham, Griffin & Moran

[57] ABSTRACT

In an aluminium reduction cell including a cell lining and embedded therein at least one cathode current collector including a high temperature section comprising an electrically conducting refractory material such as titanium diboride, generally in conjunction with molten aluminium metal, corrosion is a problem. The invention provides a substance to protect the collector section. The substance may be a liquid impermeable layer e.g. particulate material impregnated with a molten fluoride-or chloride-containing salt mixture; for a getter such as particulate aluminium to react chemically with gaseous corrosive species. Combinations of these substances may be used, optionally in conjunction with a solid layer such as an alumina or aluminium metal tube.

13 Claims, 3 Drawing Sheets

ALUMINIUM REDUCTION CELL

Conventional aluminium reduction cells comprise a lining of carbon blocks to enclose the liquid cell contents, namely a layer of molten product aluminium metal and an overlying layer of a cryolite-based electrolyte containing dissolved alumina. A carbon anode is suspended with its lower end dipping into the electrolyte. Electric current is passed between the anode and the pool of molten metal which serves as a cathode, and is withdrawn from the cathode through the carbon cell lining to steel bars embedded in the lining. Because the electrical conductivity of carbon is not very high, it has long been desired to collect cathode current by means of collectors having higher conductivity. An added advantage of the use of such cathode current collectors is that they would make it possible to construct the cell lining of a different material, e.g. a non-conducting material based on alumina.

U.S. Pat. No. 3,607,685 describes current collectors having high temperature sections of molten aluminium metal contained in a refractory or steel tube. The tube may contain also Al-wettable refractory rods or fibers to retain metal movement. However, the magnetic forces generated in a large modern cell stir the molten metal to such an extent as to make conductors of this kind impractical.

There has been considerable difficulty in finding electrically conducting materials that are solid and are capable of withstanding the highly corrosive conditions existing in an aluminium reduction cell, which typically operates at temperatures of 950° to 1000° C. Suitable materials include refractory hard metals, including the refractory carbides, nitrides and borides of transition metals. Particularly, titanium diboride has been widely proposed for such use. British Patent Specification No. 1065792 describes cathode current collectors embedded in a carbon cell floor and comprising titanium diboride rods at their high temperature ends joined to metal bars at their low temperature ends, this arrangement having the advantage of using as little of the expensive titanium diboride refractory as possible.

U.S. Pat. No. 3,095,370 proposes the use of titanium diboride rods as cathode current collectors embedded in an alumina-based cell lining. U.S. Pat. No. 3,287,247 addresses the problem of corrosion of these rods and seeks to overcome the problem by lining the rods with materials to minimise ingress of aluminium and minimise current leakage. Since the corrosive species were believed to be liquid (eg Al or Na), the linings were designed to exclude such liquids. The linings would in general have been ineffective to exclude gaseous species.

Titanium diboride and other electrically conducting refractory hard metals (RHMs) are not only expensive, but are also difficult to shape, also difficult to machine and are brittle. EPA 145411 describes cathode current collectors of which the high temperature section comprises both titanium diboride (or other electrically conducting refractory material) and aluminium metal present at least partly in the molten state, the aluminium metal serving to improve the room temperature mechanical strength and toughness of the collector and to maintain electrical connection in the event of fracture of the titanium diboride pieces during operation.

It will be appreciated that cathode current collectors extend over a substantial temperature range, from the interior of the cell at 950° to 1000° C. to the shell of the cell at a temperature of perhaps 200° C. In steady state operation, the cell lining and the cathode current collectors embedded in it assume a temperature profile which may be considered as containing stationary isotherms. The electrolyte penetrates the cell lining down to an isotherm corresponding to its solidus, typically 700° to 800° C. Where a cathode current collector includes a high temperature section comprising a RHM such as titanium diboride or a composite including such RHM and a low temperature section consisting of a metal bar, the joint needs to be positioned at an isotherm that takes account of the mechanical and electrical properties of the metal; when the metal bar is made of aluminium, the joint should generally not be allowed to rise above about 500° C.–600° C. There is thus a gap, between the 5°–600° C. and the 7°–800° C. isotherms where in steady state operation a cathode current collector comprising RHM or RHM composite is not protected by surrounding fluid electrolyte.

Our researches into cathode current collectors comprising RHM and RHM composites have revealed that it is predominantly in this unprotected section that corrosion of metal and/or RHM or RHM composite is liable to occur during operation of the cell. Corrosion is not caused by cell electrolyte, nor by molten product metal, for titanium diboride has been shown to be stable to both these materials. The cause of corrosion is believed due to the presence of corrosive gaseous species, e.g. oxygen, nitrogen, hydrogen fluoride, carbon monoxide, carbon dioxide, and/or water. These corrosive species are present in the cell within voids or adsorbed on the surface of various materials comprising the cell elements. In addition, corosive species (e.g. air or water) external to the cell may enter through various mechanical openings in the shell, permeate the lining porosity, and reach the collector bar surface. The problem is aggravated by the fact that corrosion may result in the conversion of corrosive gaseous species, e.g. oxygen, to solid ones, e.g. oxides. This reduces pressure at the site of corrosion and thus draws more gas, which may be corrosive, towards it.

The following are believed to function as corrosion activators:

fluoride vapours
$Na_2O$, $K_2O$, $Li_2O$
$B_2O_3$
$P_2O_5$.

It is believed that there are two means of accelerating oxygen transport through an oxide film that are active in a reduction cell:

(a) Incorporation of $F^-$ ions in solid oxide crystal structure which are associated with creation of oxygen vacancies, which increase the diffusion flux of oxygen through the solid film.

(b) Formation of a low melting oxide/oxyfluoride liquid slag in which species can be oxidised on the gas-slag interface and then diffuse through the slag to the slag-metal interface to be partially reduced.

It is an object of this invention to overcome this corrosion problem.

The invention provides an aluminium reduction cell including a shell containing a lining and embedded therein at least one cathode current collector including a section comprising an electrically conducting refractory material characterized in that there is provided within the shell at least one substance which is at least partly fluid and/or reactive with gaseous corrosive species to protect the current collector section from corrosion.

We have reached the conclusion that a solid physical barrier is by itself ineffective to prevent ingress of corrosive gases, due partly to the fact that many barrier materials are permeable to gases and partly to the difficulty of preventing ingress of corrosive gases round the edges or ends of such a barrier. That is why we have specified that the protective substance is (at least partly) fluid when the cell is in operation, or reactive with corrosive gases, or both (at least partly) fluid and reactive with corrosive gases.

Various substances can be used for this purpose and constitute different embodiments of this invention:

A surrounding impermeable layer, which is at least partly fluid and/or reactive with gaseous corrosive species to liquid when the cell is in operation, may physically protect the section from chemical attack.

A getter may be included in the cell lining to react chemically with gaseous corrosive species.

These different embodiments can be used separately or together or in conjunction with a solid physical barrier as more fully described hereafter. The design of the collector section is not critical. It may, for example, consist of electrically conducting refractory material. Or it may comprise refractory material in association with metal, e.g. discrete bodies of refractory material joined or surrounded by metal. The metal may be aluminum, present at least partly in a fluid state to ensure a continuous path for electric current. The collector section may be designed so that either the metal or the refractory material is the main carrier of electric current. The section preferably includes a major proportion by volume of discrete electrically conducting metal-wettable refractory bodies. Depending on the circumstances, corrosion may damage either the metal or the refractory material or both metal and refractory.

The electrically conducting refractory material is preferably a RHM, particularly titanium diboride, or a RHM composite. The design of the cathode current collectors may suitably be according to our EPA No. 145411 mentioned above. In this, the cathode current collector comprises a high temperature section of titanium diboride (or other electrically conducting refractory material) and partly fluid aluminum welded to a low temperature section consisting of an aluminum bar. The high temperature section may be contained in a ceramic tube, whose function is to prevent the the egress of liquid from the collector and ingress of liquid from the surrounding cell lining. But such a tube is not impervious and would not be effective to protect the RHM composite from chemical attack by reactive species in the vapour phase.

According to one embodiment of the invention there is used an impermeable layer of at least partly liquid protective material. This preferably surrounds the high temperature section of the cathode current collector over its entire length, from the joint with the low temperature section to the molten metal pad. Alternatively, the impermeable layer of protective material may extend from the joint with the low temperature section only as far as an isotherm corresponding to the solidus of the cell electrolyte, the assumption being made that at higher temperatures the cathode current collector will be protected by a surrounding sheath of liquid cell electrolyte. This alternative is not preferred, because the cell electrolyte takes days or weeks after start-up to fully penetrate the cell lining, and corrosion is particularly likely to occur during that initial period. Of course, at sufficiently low temperatures, electrically conducting refractory materials are unlikely to be reactive with corrosive species in the cell and may not therefore need protection; but these conditions are unlikely to arise, because it is generally cheaper to use metal conductors at low temperatures.

The impermeable layer is preferably sealed to the low temperature section. Alternatively it may surround the low temperature section over a substantial part of its length. These measure either totally deny access of corrosive gases to the high temperature section, or ensure that the route to the high temperature section is so long that virtually no corrosive gases gain access to it.

A liquid layer can have the advantage over a solid one of readily forming a seal at the junction of the high and low temperature sections of the collector. Various liquids may be used:

(a) Metallic aluminium is a suitable liquid which can easily be applied by cladding the collector bar with aluminium sheet, but has drawbacks. It has a very high thermal conductivity and thus increases the vertical heat drain considerably. Moreover, it is not oxidation resistant and thus will tend to form alumina, aluminium nitride or aluminium fluoride which in time is likely to accumulate round the collector bar and displace the protective liquid layer. Liquid aluminium may provide a useful protection during start-up in those high temperature regions of the collector bar which are subsequently protected by the electrolyte which filters down from the cell.

(b) Mixtures of salts which are molten at operating temperature are the preferred form of liquid seal.

Suitable salts include:

1. KCl, NaCl, $CaCl_2$, mp approx. 535° C.
2. $KAlF_4$, mp approx. 565° C.
3. $CaF_2$, $CaCl_2$, NaF, mp approx. 506° C.
4. $NaF/AlF_3$ mixture having a weight ratio less than 1, i.e. approaching eutectic composition, mp approx. 690°.

Salt mixture 1 has the advantages of relatively low melting point, non-volatile, inert to the collector bar and to oxidizing species, readily wets and protects the collector bar, and is the most preferred.

Molten salt sealants should preferably be present in a bed of inert solid aggregate or powder, e.g. of cell lining material, such that capillary action causes the salt to be retained in the spaces between the solids. If this is not done, there is danger that liquid aluminium, if present, may upwardly displace the lower density molten salt. One way of preparing such layers, as described in more detail in the example below, involves embedding the collector bar in cell lining material and impregnating the cell lining material with the molten salt.

Sufficient salt needs to be included in the layer of lining material around the collector bar to totally fill all the connected porosity of the lining material and form a gas tight seal. This is particularly important since halide vapours in the gas phase are well-known to activate the oxidation reactions, so that partial filling of the porosity can produce increased corrosion rather than preventing it. Once in place round the collector bar, downward migration of the salt through the lining is prevented by the temperature gradient, since the liquid will not penetrate the lining material below its eutectic temperature. In cases where the collector bar operates at a higher temperature than the surrounding lining, the sideways migration of the liquid layer is similarly limited.

In some cases it may be necessary to restrain the liquid sealing layer from horizontal movement in the cell lining, and this can readily be done by means of a solid impermeable tube or cylinder. Indeed, the combination of an impermeable liquid layer with a surrounding solid sheath forms the preferred embodiment of this invention. The liquid may be any of those noted above. The solid sheath may be a simple alumina tube because in these circumstances it does not need to be impermeable to corrosive gaseous species.

Alternatively, the solid sheath may be provided by a pre-formed tube. The tube may be formed of sintered alumina or of an alumina-based ceramic such as mullite or aluminate spinel. Or it may be formed of an alumina-based castable cement or aggregate impregnated by molten cryolie or molten cell electrolyte to seal the pores. Or the tube may be formed of aluminium nitride which is, however, considerably more expensive than the other materials mentioned. One end of the tube is preferably sealed to the metal bar near its junction with the high temperature section of the collector.

The impermeable layer may comprise a steel tube. Such a tube may readily be sealed, e.g. by welding, to the low temperature section of the collector. But at high temperatures steel is itself subject to high temperature fluoride accelerated corrosion in the cell environment.

The cross-sectional area of the high temperature section of a cathode current collector is likely in most cases to be in the range 5 to 75 $cm^2$. An annular gap of for example 10 to 20 mm may be left between the collector bar surface and the inner surface of a solid sealing tube, and the liquid sealing mixture introduced into this gap. The outer tube may typically have a wall thickness of from 1 to 8 cm with an outside tube diameter of about 17 to 23 cm.

According to another embodiment of the invention, gaseous species reactive with the refractory material may be removed chemically by providing a getter within the cell. Various materials may be used as getters. Thus basic oxides such as $Na_2O$ or CaO can be used as getters for HF, although care needs to be taken since these compounds also react with alumina aggregate, and if placed in contact with the collector bar tip may themselves activate the corrosion by forming low melting glass compositions on the surface of the corroding bar. Carbon can be used as a getter for oxygen in cases where the resulting carbon oxides are themselves not reactive with the cathode current collectors. Preferred getters are reactive metals such as Al, Mg or Ti.

For example, for every 22.4 l at STP of air in the lining a minimum of 42 g Al is required to consume $N_2$ and 8 g Al to consume $O_2$. Assuming approximately 40% void volume in the lining, this corresponds to approximately 0.9 $kg/m^3$ or 0.04% by weight of the lining. Getter loadings of 0.5% to 5% by weight are preferred, and up to 10% can be added without seriously deteriorating the lining stability or electrical and thermal characteristics.

Getters may be concentrated in a particular part of the cell such as around the collector or around any residual openings in the shell, but are preferably distributed evenly throughout the cell lining. Getters should generally be used in finely divided form for efficient reaction with gaseous species. Or getters may be provided as massive components such as consumable cylinders round collector bars or oxidizable side walls.

A getter may be used in conjunction with a solid or liquid impermeable layer to protect the collector section from corrosion. The use of several techniques at the same time has the advantage of requiring less getter to perform its desired function. A getter is useful in conjunction with a permeable or impermeable solid or liquid layer because it protects the top part of the collector bar, which may be unsealed, during start-up and before impregnation by electrolyte of the top of the lining has been fully achieved.

A layer of protective material for use in conjunction with a getter may be a uniform pinhole-free impermeable coating applied to the pre-formed collector. Several techniques are available to do this:

(i) Chemical vapour deposition of for example TiC, TiN, BN, or AlN.

(ii) Physical vapour deposition by various techniques. For example, a protective layer may be deposited by electron beam evaporation, allows almost unlimited choice of coating media and substrates. Or the layer can be deposited by Ion plating. However $Al_2O_3$ or AlN are preferred.

(iii) Plasma spraying is another technique for deposition of protective layers. In this process, the protective medium in powder form is melted in a plasma gun and sprayed onto the substrate. Typically, slightly porous coatings are produced by plasma spraying.

Residual porosity in coatings produced by methods (ii) and (iii) may if desired be removed by a method of laser consolidation.

(iv) The collector bar may be clad with a thin aluminum sheet by pressure welding or vacuum casting. Then the aluminium surface may be anodized to produce a film of alumina, which may be rendered non-porous by laser consolidation as mentioned above.

(v) The collector bar may be dipped into a molten low-ratio electrolyte containing dissolved alumina. The bar acts as a "cold finger" causing precipitation of alumina onto its surface to form a dense coating.

The coating techniques described above are continued for long enough to form an impermeable layer on the surface of the collector bar. The thickness of the layer depends on the coating technique, but is likely to be of the order of several millimetres, or more in the case of (v).

Reference is directed to the accompanying drawings, in which.

Figure 1:
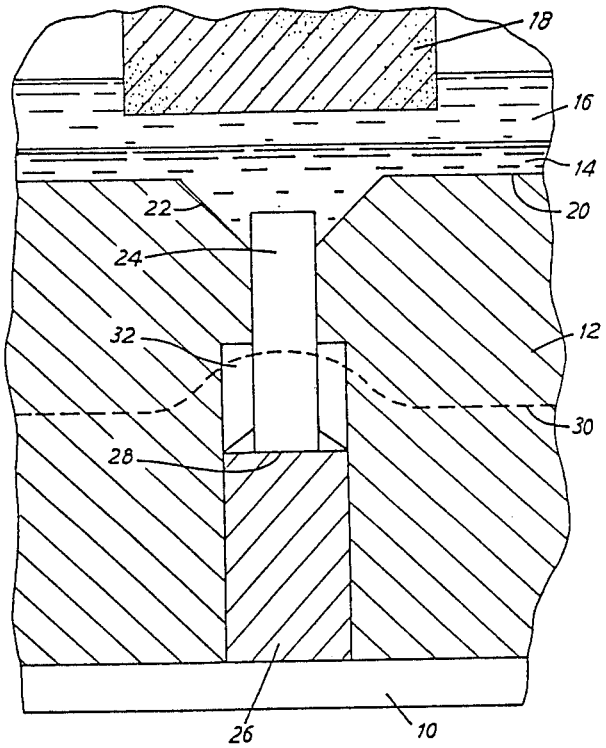
FIG. 1 is a sectional side elevation of part of an aluminium reduction cell according to this invention.

Referring to FIG. 1, the aluminium electrolytic reduction cell comprises an aluminium shell 10, a cell lining 12 comprising a mixture of sintered alumina balls and tabular alumina powder, a layer 14 of molten product aluminium metal, an overlying layer 16 of a cryolite-based molten electrolyte containing dissolved alumina, and an anode 18, the lower end of which dips into the electrolyte. The floor 20 of the cell includes a depression 22. A cathode current collector extends from the bottom of this depression to the shell 10 and comprises a high temperature section 24 containing titanium diboride and low-temperature section 26 consisting of an aluminium bar, the two sections being welded together at 28. A dotted line 30 represents the 750° C. isotherm within the cell lining.

An impermeable layer 32 of at least partly fluid protective material is shown surrounding part of the high temperature section 24 of the cathode current collector. This layer extends from the joint 28 up to about the 800° C. isotherm in the cell lining. In operation, cell electrolyte will percolate down from the layer 16 and will impregnate the cell lining down to about the 750° C. isotherm 30. Thus the high temperature section 24 of the cathode current collector will be protected from corrosion along its entire length, at its upper end by means of surrounding liquid electrolyte and aluminium and at its lower end by means of the impermeable layer 32 of protective material.

Figure 2:
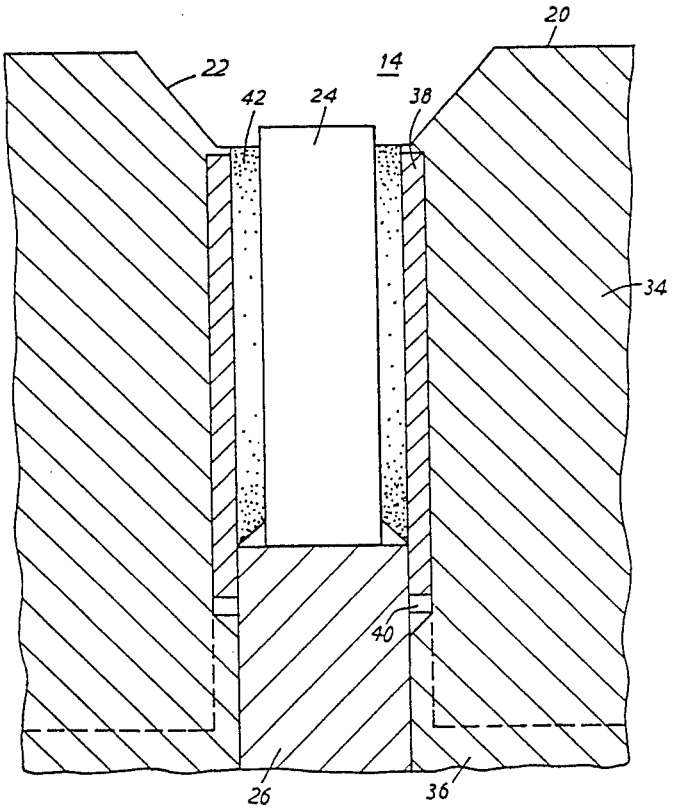
FIG. 2 is a corresponding view of a preferred embodiment.

FIG. 2 is a view in the same sense as FIG. 1, and the same reference numerals are used where possible. The cell lining comprises a dense upper layer 34 of mixed sintered alumina balls and tabular alumina powder, and a light lower layer 36 of alumina powder. A double layer of protective material surrounds the high temperature section 24 of the cathode current collector along its entire length (except for the tip at the top end which is immersed in the molten product metal 14 of the cell). An outer layer 38 is constituted by a cylinder of sintered alumina or mullite or beta-alumina bonded alumina castable material which may thereafter be impregnated with cryolite ($NaF:AlF_3$ weight ratio 1.5). The bottom end of this cylinder is sealed against an aluminium flange 40 which in turn is 15 welded to the collector bar stud 26. An inner layer 42 comprises powered tabular alumina fully impregnated with a eutectic mixture of sodium chloride. potassium chloride and calcium chloride.

Figure 3:
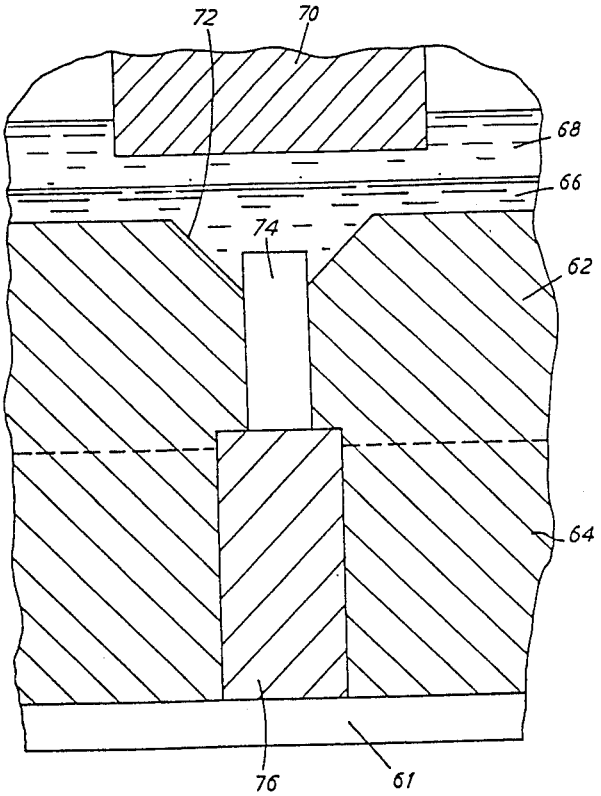
FIG. 3 and FIG. 4 are corresponding views of other embodiments of the invention.

Referring to FIG. 3, an aluminium reduction cell according to the invention comprises a shell 61 containing a potlining of two layers 62, 64, a layer or pad 66 of molten product aluminium, a supernatant layer 68 of a cryolite-based electrolyte and an anode 70 whose lower end dips into the electrolyte. The surface of the lining has a depression 72, and from that depression a collector 74, 76 carries cathode current from the molten metal pad 66 to the shell 61 (or through it) to a busbar (not shown) for connection to the next downstream cell of the series.

The collector includes a high-temperature section 74 including a major proportion by volume of RHM or RHM composites joined or surrounded by aluminium containing metal; welded to a low-temperature section 76 consisting of a metal bar which is joined at the lower end to the shell 61.

The lower layer 64 of the lining is of alumina powder. The upper layer 350 mm thick is of mixed sintered alumina balls and tabular alumina powder and contains 3% by weight Al flake as a getter for reactive species.

In trials of an experimental cell of this design, the Al flake consumed the oxygen and part of the nitrogen initially present in the lining. Post-mortem examination established that both oxidation and nitriding of Al flake had occurred.

Figure 4:
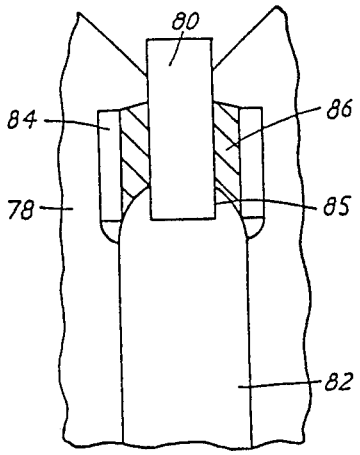

FIG. 4 shows a similar view. An aluminium reduction cell includes an alumina cell lining 78 in which is embedded a cathode current collector comprising a high temperature sectin 80 containing titanium diboride and a low temperature section 82 consisting of a metal bar. Surrounding the lower part of the high temperature section 80 is a thick-walled tube 84 of metal, the lower end of which is joined to the bar 82 near its junction 85 with the high temperature section. The metal bar and the tube may advantageously be of aluminium, and the joint may be made by welding. An annular gap between the high temperature section 80 and the tube 84 is filled with a mixture 86 of alumina and a salt mixture such as $NaCl-KCl-CaCl_2$ which is molten when the cell is in operation. The alumina is particulate, more finely divided than the alumina of the surrounding cell lining 78, so that the molten salt is held in place by capillary forces.

With proper design, the cup will remain below 660° C. (the melting point of Al) up to its top. The design is cheap in terms of materials and construction, and has the advantage that it provides mechanical protection to the high temperature section 80 and its joint 85 with the bar 82.

EXAMPLE 1

Figure 5:
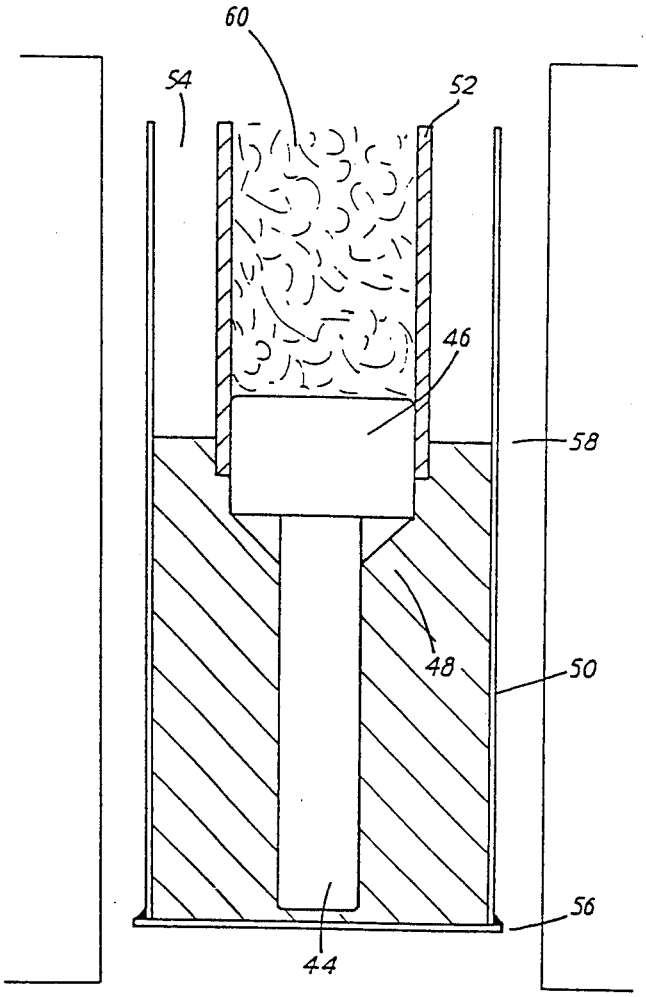
FIG. 5 is a sectional side elevation showing a method of preparing a protected cathode current collector.

This example describes the preparation of a cathode current collector protected from chemical attack by means of a surrounding impermeable layer of protective material. Referring to FIG. 5, a high-temperature section 44 of a cathode current collector is prefabricated comprising a major proportion of titanium diboride and a minor proportion of aluminium metal. This is welded or cast to a short extension 46 (the stud extension) of aluminium metal. The section and stud extension are embedded in a well packed tabular alumina mixture 48, typically consisting of fine and medium fractions having relatively high bulk density (typically greater than 2500 kg. $m^{-3}$), in a steel jacket 50. A ceramic or similar riser 52 is used to protect the upper section of the stud extension from disturbance by subsequent molten bath addition. Loose insulation may be used within the ceramic riser 52.

The assembly is heated throughout to a temperature above the melting point of the molten salt mixture to be used which may be above the liquidus of the aluminium. A molten salt mixture for example, a $NaCl - CaCl_2 - KCl$ eutectic composition is added at 54 to the space surrounding the riser 52 in sufficient quantity to fully impregnate the tabular alumina mix 48. The assembly is maintained at elevated temperature until no more molten salt mixture penetrates the tabular alumina, at which time the assembly is directionally cooled from the bottom upwards, so as to ensure a fully dense protection device. When fully cooled, the protection device is cut at 56 and 58 and the aluminium stud extension 46 is prepared for welding to the remainder of the low temperature section of the collector bar. The cathode current collector is now ready for installation in the lining of an electrolytic cell. The steel outer cylinder 50 may be retained as a temporary barrier to prevent bath leakage into the new lining until normal bath penetration can occur (one to two weeks from start-up).

The nature of the molten salt mixture used in the above method can be varied.

EXAMPLE 2

Collector bars having an unprotected titanium diboride composite tip were used to conduct electric current from a molten Al cathode pad of an Hall-Heroult Al reduction cell through an alumina powder aggregate lining. The cell operated at a temperature of 980° C. for 1 month utilizing electrolyte composed of $NaF-AlF_3-CaF_2$ salt mixture. The experimental run was terminated due to active corrosion of the titanium diboride composite collector bar tip. The most severe corrosion took place 5 cm below the bottom of the collector bar depression in the lining. In this location the total penetration of the lining by electrolyte ended and both liquid electrolyte and air were available for corrosion. A subsequent experimental run utilized the assembly prepared in Example 1.

The cell was operated under the same conditions for a period of 1 month during which time the collector bars sealed in the above manner showed no appreciable change in electrical resistance. On post-mortem it was determined that there were no dimensional changes in the collector bar tips and no corrosion could be detected on macroscopic evaluation of the collector bar section.

We claim:

1. An aluminium reduction cell including a shell containing a lining and embedded therein at least one cathode current collector including a section comprising an electrically conducting refractory material, characterized in that there is provided within the shell at least one substance which is fluid and/or reactive with gaseous corrosive species to protect the current collector section from corrosion, which substance is an impermeable layer which surrounds the section and physically protects the section from chemical attack.

2. A cell as claimed in claim 1, wherein the collector section includes discrete electrically-conducting refractory aluminium-wettable bodies joined or surrounded by aluminium-containing metal.

3. A cell as claimed in claim 1, wherein the electrically conducting refractory material is titanium diboride or a composite material comprising a major proportion of titanium diboride.

4. A cell as claimed in claim 1, wherein the cell lining material is based on alumina.

5. A cell as claimed in claim 1, wherein the impermeable layer comprises particulate material impregnated with a fluoride- and/or chloride-containing salt mixture which is molten when the cell is in operation.

6. A cell as claimed in claim 1, wherein the impermeable layer is composite and comprises an inner layer of a salt mixture which is at least partly fluid when the cell is in operation, and an outer layer which is a pre-formed tube of alumina-based material.

7. A cell as claimed in claim 1, wherein the impermeable layer is composite and comprises an inner layer of particulate material impregnated with a salt mixture which is molten when the cell is in operation, and an outer layer which is a tube of metal.

8. A cell as claimed in claim 7, wherein the cathode current collector includes a low temperature section consisting of a metal bar, to which one end of the tube is joined.

9. A cell as claimed in claim 8, wherein both the metal bar and the tube are of aluminium.

10. An aluminium reduction cell including a shell containing a lining and embedded therein at least one cathode current collector including a section comprising an electrically conducting refractory material, characterized in that there is provided within the shell at least one substance which is fluid and/or reactive with gaseous corrosive species to protect the current collector section from corrosion, which substance is a getter which reacts chemically with gaseous corrosive species present in the cell lining.

11. A cell as claimed in claim 10, wherein the getter is a reactive particulate material dispersed in the cell lining.

12. A cell as claimed in claim 11, wherein the getter is particulate aluminium metal present in an amount of 0.5% to 5% by weight in an alumina-based cell lining.

13. A method of preparing a cathode current collector, including a section comprising an electrically conducting refractory material, for use in an aluminium reduction cell lining in which it is protected from chemical attack by means of a surrounding impermeable layer of protective material, which method comprises forming an assembly by embedding the section in well packed cell lining material, heating the assembly, impregnating the cell lining material with a molten salt mixture, and cooling the assembly.

* * * * *